US008252169B2

(12) United States Patent
MacArthur et al.

(10) Patent No.: US 8,252,169 B2
(45) Date of Patent: Aug. 28, 2012

(54) PROCESS FOR UPGRADING COAL PYROLYSIS OILS

(76) Inventors: James B. MacArthur, Denville, NJ (US); James J. Colyar, Newtown, PA (US); John E. Duddy, Langhorne, PA (US)

( * ) Notice: Subject to any disclaimer, the term of this patent is extended or adjusted under 35 U.S.C. 154(b) by 696 days.

(21) Appl. No.: 12/316,611

(22) Filed: Dec. 16, 2008

(65) Prior Publication Data

US 2010/0147743 A1 Jun. 17, 2010

(51) Int. Cl.
*C10G 65/02* (2006.01)
*C10G 65/12* (2006.01)

(52) U.S. Cl. ..... 208/57; 208/58; 208/59; 208/89; 208/403

(58) Field of Classification Search ..... 208/57–59, 208/89, 400, 403, 412, 413
See application file for complete search history.

(56) References Cited

U.S. PATENT DOCUMENTS 3,519,553 A 7/1970 Johnanson
3,791,959 A 2/1974 Mills
3,844,933 A * 10/1974 Wolk et al. ..... 208/59
4,581,131 A * 4/1986 Rudnick ..... 208/263
4,816,141 A * 3/1989 McLean et al. ..... 208/413
4,842,719 A 6/1989 MacArthur
4,853,111 A * 8/1989 MacArthur et al. ..... 208/421
4,874,506 A 10/1989 MacArthur
4,879,021 A 11/1989 Hippo
5,198,099 A * 3/1993 Trachte et al. ..... 208/89
5,968,346 A * 10/1999 Jung et al. ..... 208/210
6,036,844 A * 3/2000 Gupta et al. ..... 208/49
6,270,654 B1 * 8/2001 Colyar et al. ..... 208/57

OTHER PUBLICATIONS

Fleming et al, AFWAL-TR-87-2042, Production of Jet Fuels From Coal Derived Liquids—vol. VI, Sep. 1988, Air Force Wright Analytical Laboratory.
Furlong et al, AFWAL-TR-87-2042, Production of Jet Fuels From Coal-Derived Liquids—vol. XII, Dec. 1989, Air Force Wright Analytical Laboratory.

* cited by examiner

*Primary Examiner* — Walter D Griffin
*Assistant Examiner* — Renee E Robinson

(57) ABSTRACT

This invention utilizes a novel method and set of operating conditions to efficiently and economically process a potentially very fouling hydrocarbon feedstock. A multi-stage catalytic process for the upgrading of coal pyrolysis oils is developed. Coal Pyrolysis Oils are highly aromatic, olefinic, unstable, contain objectionable sulfur, nitrogen, and oxygen contaminants, and may contain coal solids which will plug fixed-bed reactors. The pyrolysis oil is fed with hydrogen to a multi-stage ebullated-bed hydrotreater and hydrocracker containing a hydrogenation or hydrocracking catalyst to first stabilize the feed at low temperature and is then fed to downstream reactor(s) at higher temperatures to further treat and hydrocrack the pyrolysis oils to a more valuable syncrude or to finished distillate products. The relatively high heat of reaction is used to provide the energy necessary to increase the temperature of the subsequent stage thus eliminating the need for additional external heat input. A refined heavy oil product stream is recycled to the fresh feed to minimize feedstock fouling of heat exchangers and feed heaters.

23 Claims, 1 Drawing Sheet

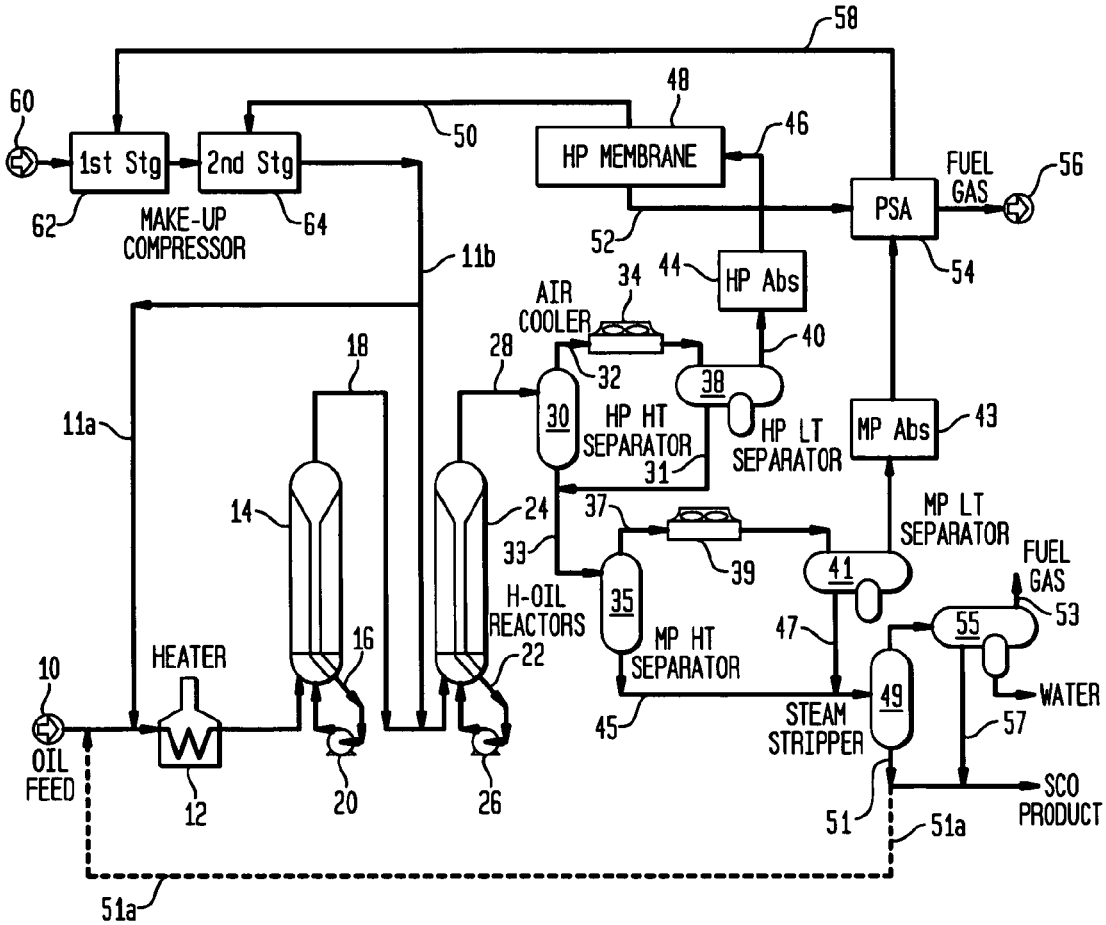
58
60
1st Stg
2nd Stg
50
48
HP MEMBRANE
46
FUEL GAS
56
62
MAKE-UP COMPRESSOR
64
52
PSA
54
11b
34
44
HP Abs
AIR COOLER
40
18
28
32
38
11a
30
HP HT SEPARATOR
HP LT SEPARATOR
MP Abs
43
31
14
24
37
MP LT SEPARATOR
33
39
41
FUEL GAS
H-OIL REACTORS
35
53
16
47
55
HEATER
22
MP HT SEPARATOR
10
49
WATER
45
STEAM STRIPPER
57
OIL FEED
12
20
26
51
51a
SCO PRODUCT
51a

PROCESS FOR UPGRADING COAL PYROLYSIS OILS

BACKGROUND OF THE INVENTION

1. Field of the Invention

This invention relates to a multi-stage catalytic process for upgrading coal pyrolysis oils with the objective of producing valuable gasoline, jet fuel, and diesel fuel. Coal Pyrolysis Oils are highly aromatic, olefinic, and are unstable. Additionally, they contain objectionable sulfur, nitrogen, and oxygen contaminants, and may also contain coal solids that would plug fixed-bed reactors.

2. Description of Prior Art

Coal is the world's most abundant fossil fuel. However, coal has three major drawbacks: (1) Coal is a solid and is less easily handled and transported than fluidic or gaseous materials; (2) Coal contains compounds which, upon burning, produce "air toxics" and the pollutants associated with acid rain; and (3) Coal is not a uniform fuel product, varying in characteristics from region to region and from mine to mine. In fossil fuels, the ratio of hydrogen atoms to carbon atoms is most important in determining the heating value per unit weight. The higher the hydrogen content, the more liquid (or gaseous) the fuel, and-the greater its heating value. Natural gas, or methane, has a hydrogen-to-carbon ratio of 4 to 1 (this is the maximum); gasoline has a ratio of about 2.2 to 1; petroleum crude about 2.0 to 1; shale oil about 1.5 to 1; and coal about 1 to 1. Thus, if coal is processed and the hydrogen on half the carbons could be transferred or "rearranged" to the other half of, the carbons, then the result would be half the carbons with 0 hydrogens and half with 2 hydrogens. The first portion of carbons (with 0 hydrogens) would be a solid char; the second portion of carbons (with 2 hydrogens) would be a liquid product similar to a petroleum derived fuel oil.

Therefore, if this could be accomplished using only the hydrogen inherent in the coal, i.e., no external hydrogen source, then the coal could be refined in the same economical manner as petroleum, yielding a slate of refined hydrocarbon products and low hydrogen containing char.

In our modern society nearly every raw material is refined prior to final use. Various raw ores are refined to produce useful products, such as aluminum, copper, silver, titanium, and tungsten. Except for coal, all of our fuels are refined: for example, uranium ore, crude oil, and natural gas are refined.

Natural gas from the wellhead contains impurities, such as $CO_2$, heavy hydrocarbons, and sulfur containing gases. These impurities are removed prior to use to yield predominantly a single hydrocarbon compound: methane. Natural gas represents less than 3% of, the United States' known energy reserves.

Crude oil from the wellhead has limited utility. It is typically a dirty, sulfur-containing fuel. Hence, the petroleum industry has developed refining processes such as hydrocracking and fluid catalytic cracking techniques to produce value-added products, such as gasoline, jet fuel, and other hydrocarbon fuels and petrochemicals. Thus, gasoline can be produced from high sulfur crude or from light Arabian crude.

Raw coal, as it is mined, also has limited utility being used mostly for direct combustion to produce heat and steam to generate electricity. Like crude oil, coal contains complex hydrocarbons, sulfur, and nitrogen. Coal also contains large amounts of mineral matter (or ash). High sulfur bituminous coals and high moisture subbituminous coals are very different raw materials and cannot be interchanged as fuels. Coal is the most abundant fossil fuel in the U.S., accounting for over 95% of the fossil energy reserves. The United States has 43% more energy in coal reserves than the energy equivalent of all the oil and gas in known reserves in the entire world. Vast deposits of coal also exist in Eastern Europe, Russia, and China but are either far away from manufacturing regions or contain high levels of pollutants relative to the heating value of the coal.

Coal refining processes, like the petroleum refining processes, can employ a range of approaches and technologies. One coal refining approach uses a thermal treatment or pyrolysis in which a rapid heatup of the coal produces gases, a liquid product, and a char. The char can be used as a high energy content boiler fuel, the gases can be recycled and used to provide heat for the pyrolysis process, and the liquids can be refined to produce valuable transportation fuels. The coal pyrolysis oils contain objectionable sulfur, nitrogen, oxygen, and solids contaminants and are deficient in hydrogen and therefore must be further refined.

The two primary approaches for coal refining for the purpose of converting coal to liquid fuels are called direct and indirect coal liquefaction. Direct coal liquefaction ("DCL") reacts coal in a solvent with hydrogen at high temperatures and pressure to produce liquid fuels. DCL was first developed by Dr. Bergius in Germany in 1913 and used commercially in Germany between 1927 and 1945. However, after World War II, crude oil was widely available at reasonable prices and commercial coal liquefaction was therefore not commercially attractive. As a result, very little liquid fuels sold today are produced using a coal liquefaction process.

Indirect coal liquefaction ("ICL") involves first gasifying coal to produce a synthesis gas which contains principally carbon monoxide and hydrogen and thereafter processing the gas chemically into a variety of fuels.

Where diesel type products are desired utilizing ICL, the Fischer-Tropsch process is preferably used to convert the synthesis gas. The ICL technology was commercially applied in the 1920-1940's in Germany and since the 1950's in South Africa. While commercially demonstrated, the ICL technologies are very complex, capital intensive, and have low thermal efficiencies compared to direct coal liquefaction.

Several technologies can be utilized for the gasification step of Indirect Coal Liquefaction. Some coals are better processed in a lower temperature moving-bed gasifier (such as the Lurgi-type used by Sasol in South Africa and by the Dakota Gasification Plant in the U.S. where the desired product is synthetic natural gas). Low temperature gasification produces pyrolysis type products including tar oils, phenolics, and crude naphtha which contain objectionable sulfur, nitrogen, phenolics, olefins, and entrained solids which must be further refined to meet environmental and end use requirements. High temperature gasification such as the entrained flow gasifiers operate at high temperature conditions that completely convert the liquids formed to synthesis gases within the gasifier thus not having any direct coal liquids produced.

For coal pyrolysis oils, product quality upgrading has been demonstrated through multiple, difficult process steps. For a fixed-bed hydrotreatment approach, the oils containing entrained solids (fine coal char, ash, and slag particles) must first undergo filtration before being hydrotreated in fixed-bed reactors. The coal pyrolysis tars are unstable and viscous making filtration difficult. The fixed-bed hydrotreaters have very short catalyst cycle lengths due to catalyst bed plugging. Several catalyst beds are required with interstage hydrogen or oil quench to control the exothermic hydrogenation reaction. As peak crude oil production nears, there is a large economic incentive for these poor quality coal pyrolysis oils to be upgraded to transportation fuels.

For Direct Coal Liquefaction, extensive research and development was conducted in the 1970's and 1980's in the United States and world-wide, as oil shortages and high oil prices were experienced. The objectives were to produce transportation fuels from coal to reduce oil imports. The US Department of Energy provided financial and technical support to demonstrate two technologies on a large scale (200 ton/day coal feed). The Exxon Donor Solvent ("EDS") technology liquefies coal with hydrogen and a hydrogen donor solvent at temperatures of 800-840° F. (427-449° C.) and pressures of 2500-3000 psia (172-207 bars). Process derived distillate coal liquids boiling at 400-700° F. (204-371° C.) are hydrotreated at mild conditions over a fixed bed of hydrotreating catalyst (typically nickel-molybdenum on alumina) and recycled as coal slurry oil. From an Illinois No. 6 coal, liquid yields of over 40 w % on dry ash free ("DAF") coal were obtained during the 2-year demonstration program.

Additionally, the H-Coal Process invented by Hydrocarbon Research, Inc. and is generally described in U.S. Pat. Nos. 3,519,553 and 3,791,959. The H-Coal Process uses a single ebullated-bed reactor with a hydroconversion catalyst to convert coal to liquid fuels. The ebullated-bed reactor is unique in its ability to process solids containing streams in the presence of high activity hydrogenation catalyst particles. Product oil (400° F.+) (204° C.+) was used to slurry the coal for feeding to the reactor. Coal liquefaction took place at temperatures of 800-875° F. (427-468° C.), and hydrogen partial pressures of 1500-2500 psia (103-172 bars). With Illinois No. 6 coal, liquid yields of greater than 50 w % on DAF coal were achieved during the multi-year year demonstration program at the 200 ton per day H-Coal Pilot Plant in Catlettsburg, Ky. The DCL technologies demonstrated commercial readiness, however, no commercial projects proceeded as oil prices fell and oil supplies increased.

In the 1980's and 1990's research continued at a smaller scale to improve the DCL technologies and reduce investments and operating costs. The Catalytic Two-Stage Liquefaction Process (CTSL) was invented by Hydrocarbon Research, Inc., as described in U.S. Patent Nos. 4,842,719, 4,874,506, and 4,879,021, to substantially increase the yield of distillate liquids from coal. For Illinois No. 6 bituminous coal, liquid yields were increased from 3 barrels per ton of MAF coal for the single stage H-Coal Process to about 5 barrels per ton of MAF coal for the CTSL Process. This was achieved by dissolving the coal feed at mild conditions while simultaneously hydrogenating the coal recycle solvent and coal liquids produced at temperatures from 600-800° F. (316-427° C.), hydrogen partial pressures of 1500-2500 psia (103-172 bars) in the presence of a hydrogenation catalyst.

In the CTSL Process, the unreacted coal from the initial stage is then fed to a direct-coupled second stage reactor operating at higher temperatures of approximately 800-850° F. (427-454° C.) and at similar pressures (1500-2500 psia) (103-172 bars) with a hydroconversion catalyst, to achieve maximum coal conversion and high distillate liquid yields. The-hydrogenation catalyst used for the single-stage and two-stage processes deactivates at these reactor conditions due to the deposition of coke and also soluble metals from the coal feed if present.

Unexpectedly and contrary to the prior art, it was learned that when the first stage reactor was maintained at least 25° F. lower temperature than the second stage reactor in the CTSL process, the coke deposited on the first stage catalyst is substantially lower than on the second stage catalyst. Moreover, the first stage catalyst activity was substantially higher than the second stage catalyst.

The low temperature first stage of direct coal liquefaction provides excellent hydrogenation of the recycle slurry oils while coal liquefaction takes place. The hydrogenation increases the coal liquid hydrogen content and also stabilizes the coal liquids.

As international fuel quality specifications have become more stringent, there became a growing need for converting coal to liquids having extremely low levels of contaminants (sulfur, nitrogen), low aromatics content, and high cetane indexes.

An improved multi-stage catalytic process to efficiently and economically process coal pyrolysis oils, a potentially very fouling hydrocarbon feedstock, is disclosed herein. These coal pyrolysis oils are highly aromatic, olefinic, unstable, and contain objectionable sulfur, nitrogen, and oxygen contaminants, and may contain coal solids which will plug fixed-bed reactors.

In the present text, "coal pyrolysis oils" covers non-gaseous products obtained from thermal treatments of coal, including gasification, and having characteristics here after described.

Accordingly, it is an objective of this invention to provide a method for the upgrading of coal pyrolysis oils, and advantageously other poor quality aromatic oils such as heavy cycle oil ("HCO") and light cycle oil ("LCO") from Fluid Catalytic Cracking, to obtain liquid hydrocarbons having substantially improved fuel value.

It is a further objective of this invention to use a back-mixed ebullated-bed reactor system to efficiently utilize the large heat of reaction.

It is yet another objective of the invention to use a lower temperature pretreatment stage to stabilize and increase the reactivity of the feedstock, reduce catalyst deactivation, and improve selectivity to desired distillate liquid products. Still another objective of the invention is to use a higher temperature second and possibly a third stage reactor to achieve the desired level of heavy oil conversion thus achieving better selectivity to high quality distillate oil products.

Another objective of the invention is to improve catalyst utilization and decrease the makeup catalyst requirements by cascading the spent catalyst from the low temperature stage 1 to the higher temperature second or third stage reactors where the remaining catalyst activity can be further utilized.

An additional objective of the invention is to recycle a portion of the heavy unconverted bottoms from the second or third stage product to blend with the raw coal liquids feedstock to minimize heat exchanger and heater fouling from the highly unstable coal pyrolysis oils when processing in the reactor system.

More specifically, the invention relates to a process of processing coal pyrolysis oils containing at least 25% wt of compounds boiling below 360° C. (680° F.) and less than 40% wt boiling at least at 520° C. (968° F.), said coal pyrolysis oil also containing less than 20% wt of coal fines, and at least 1% wt of oxygenated compounds (calculated as oxygen), said process comprising:

a) combining a hydrogen stream with said coal pyrolysis oil b) feeding the combined stream from step a) to a first ebullated-bed reactor containing a hydrogenation catalyst to remove compounds as olefins, diolefins, and nitrogen, sulfur, and oxygen contaminates, add hydrogen and create a stabilized stream; and c) feeding said stabilized stream to a second ebullated-bed reactor containing hydrogenation catalyst to remove additional heteroatoms and convert the stream; and wherein steps a-c result in the conversion of the 343° C.+ (650F.°+) material in said coal pyrolysis oil in the range of between 10 wt % and 99 wt %.

SUMMARY OF THE INVENTION

The pyrolysis oil is fed with hydrogen to a multi-stage ebullated-bed reactor (operating as hydrotreater and hydrocracker) containing an appropriate catalyst to first stabilize the feed at low temperature and is then fed to downstream reactor(s), containing an appropriate catalyst, operated at higher temperatures to further treat and hydrocrack the pyrolysis oils to a more valuable synthetic crude oil or to finished distillate products. The relatively high heat of reaction is used to provide the energy necessary to increase the temperature of each reactor stage thus eliminating or reducing the need for additional external heat input. A refined heavy oil product stream can be recycled to the coal pyrolysis oil to minimize feedstock fouling of heat exchangers and feed heaters.

GENERAL DESCRIPTION OF THE INVENTION

More specifically, the invention relates to a process of processing coal pyrolysis oil containing at least 15% wt of compounds boiling below 360° C. (680° F.) and less than 40% wt boiling at least at 520° C. (968° F.), said coal pyrolysis oil also containing less than 20% wt of particles of coal having a size of less than 1 mm, and at least 1% wt of oxygenated compounds (calculated as oxygen), said process comprising:

a) combining a hydrogen stream and coal pyrolysis oil feedstock;

b) feeding the combined stream from step a) to a first ebullated-bed reactor containing a hydrotreatment catalyst to remove compounds as olefins, diolefins, and nitrogen, sulfur, and oxygen contaminates, add hydrogen and create a stabilized stream; and c) feeding said stabilized stream to a second ebullated-bed reactor containing hydrotreatment and/or hydrocracking catalyst to remove additional heteroatoms and convert the stream;

and optionally d)feeding said converted stream to one or more additional ebullated-bed reactors for further heteroatom removal and for conversion of the 343° C.+ (650F.°+) materials; and wherein steps a-c (or d if d is present) result in the conversion of the 343° C.+ (650F.°+) material in said coal pyrolysis oil feedstock in the range of between 10 wt % and 99wt %.

The coal pyrolysis oil contains less than 20% wt of particles of coal having a size of less than 1 mm.

For determining the quantity of these particles which are not soluble in THF (tetrahydrofuran), the following test is carried out. A sample of oil is extracted overnight (about 15 h) in a Soxhlet apparatus with boiling THF, in an amount of 15:1 ml/ml at atmospheric pressure. Residual THF is removed by subsequent extraction (about 1 h) with toluene; then the residue is dried at 105° C. for 30 minutes. The percentage of THF insolubles is equal to the ratio of quantity of residue (in g)×100 to the quantity of initial sample (in g).

The coal pyrolysis oil contains at least 1% wt of oxygenated compounds (calculated as oxygen), generally at least 2% wt. In the coal pyrolysis oil, at least 15% wt of compounds are boiling below 360° C. (680° F.), preferably at least 25% or 30% or 40% and less than 40% wt are boiling at least at 520° C. (968° F.), preferably less than 30% or 15%. Some typical analyses of coal pyrolysis oils are shown in Table 1.

In the refinery scheme, this process allows to enhance the value of streams which are generally burned or treated as wastes; in fact the present process may also process additional feedstocks along with the coal pyrolysis oils, for example one or more streams selected from a group consisting of: FCC slurry oil, phenolics, FCC light cycle oil, decant oil, anthracene oil, coke oven oils, petroleum derived pyrolysis oils, and steam cracker tars; such stream is combined with the coal pyrolysis oil and is processed with the hydrogen stream in step a).

The mixture thus obtained preferably shows properties here above described.

Advantageously, a separate heavy wax stream from Fischer-Tropsch processing of synthesis gases, which may contain solids such as catalyst fines, is combined and processed with the hydrogen stream and coal pyrolysis oil feedstock of step a), preferably at a concentration of 3 wt % to 30 wt % of the coal pyrolysis oil feedstock.

Preferably, in the process of the invention, conversion is greater than 30% wt, or greater than 50% wt, advantageously greater than 75% wt or greater than 90% wt or greater than 95% wt. Preferably, steps a-c (or d if d is present) result in the reduction of sulfur, nitrogen, and oxygen contaminants in said coal pyrolysis oil of greater than 70% or greater than 90% or greater than 95%.

Typically, the first ebullated-bed reactor from step b) is operated at 360° C.-420° C. (about 680-788° F.), and 69-275 bars (about 1000-4000 psia) hydrogen partial pressure and at a feed rate of 0.5-2.0 volume of feed/hr/settled volume of catalyst in the reactor.

Conversion in the first ebullated-bed reactor is generally minimized to less than 50% wt.

Typically, the second ebullated-bed reactor from step c) is operated at a temperature of 400-440° C. (about 750-830° F.), 69-275 bars (about 1000-4000 psia) hydrogen partial pressure, and a feed rate of 0.2-2.0 volume of feed/hr/settled volume of catalyst in the reactor.

Generally supported catalyst containing NiMo or CoMo are used, the preferred support being alumina but any catalyst known for hydrotreatment/hydrocracking in ebullated-bed can be used. Catalysts used in $1^{st}$ and $2^{nd}$, and optionally $3^{rd}$ ebullated-bed reactor can be identical or different.

Preferably, after separation (including at least an atmospheric distillation) of the effluent from the last ebullated-bed reactor, at least part of the atmospheric residuum (which generally is boiling above 343° C.+(650° F.)) is recycled to the process as blended with the hydrogen stream and coal pyrolysis oil of step a), but it may be recycled in step c). Advantageously, the spent catalyst from the ebullated-bed in step b) is cascaded to and used in the ebullated-bed reactor of step c).

It is advantageous that the combined stream from step b) is first processed in an interstage separator prior to step c) to remove heteroatom gases ($H_2O$, $H_2S$, $NH_3$, $CO_2$), light hydrocarbon gases, and to provide a lower volumetric liquid feedstock for stage two. Generally, additional hydrogen is fed to the ebullated-bed reactor of step c).

BRIEF DESCRIPTION OF THE DRAWINGS

FIG. 1 is a schematic flow diagram of a catalytic multi-stage process for upgrading coal pyrolysis oils in accordance with the current invention.

DETAILED DESCRIPTION OF THE INVENTION

In this novel process, the coal pyrolysis oil feed (10) is mixed with a hydrogen stream (11*a*) and heated in a heater or heat exchanger (12) to control the feed temperature and thereafter fed to a first stage back-mixed ebullated bed reactor (14) operating at a mild severity of 360-420° C. (about 680-788° F.) temperature, and 69-275 bars (about 1000-4000 psia) hydrogen partial pressure at a feed rate of 0.5-2.0 volume of feed/hr/settled volume of catalyst in the reactor. Typical properties for this feedstock (10) are shown in Table 1. Although not shown, fresh hydrogenation catalyst, for example nickel-molybdenum on alumina, is added to the stage 1 ebullated-bed reactor (14) and aged catalyst is removed. The feedstock (10) being fed to the stage 1 ebullated-bed reactor (14) is at a significantly lower temperature than the weight average catalyst bed temperature(WABT), which allows, the large heat of reaction to increase the catalyst bed temperatures to the desired WABT and reduces or eliminates feed fouling of the heaters or heat exchangers. An ebullated-bed reactor liquid product stream (16) from this first reactor stage is recycled to the stage 1 reactor through the ebullating pump (20) to provide back-mixing which minimizes the temperature difference across the reactor and also expands the ebullated-bed catalyst to the desired level. At the low stage 1 reactor temperatures, hydrogen is added to the pyrolysis liquids and olefins and di-olefins in the feedstock are decreased to provide a more stable material which can then be hydrotreated and hydrocracked without fouling of the hydrogenation catalyst. Conversion of vacuum gas oil and heavier feed (343° C.+) (650° F.+) in this stage 1 ebullated-bed reactor (14) is minimized to less than 50%. Optionally, a heavy liquid product stream from fractionation (51*a*) can be recycled to the first reactor to minimize heat exchanger fouling by the fresh feed and to increase the concentration of heavy (343° C.+) (650° F.+) coal liquids in the reactor and increase the conversion to more valuable 343° C.− (650° F.−) distillate products.

The product stream (18) from the first stage ebullated-bed reactor (14) is fed to a direct-coupled second stage ebullated-bed reactor (24) operating at higher severity to achieve the desired heavy oil conversion and heteroatom reduction. Operating conditions can be set to also reduce aromatics in the product fraction. The second stage reactor (24) typically operates at a temperature of 40-440° C. (about 750-830° F.), 69-275 bars (1000-4000 psia) hydrogen partial pressure, and a feed rate of 0.2-2.0 volume of feed/hr/settled volume of catalyst in the reactor (based on the stage 1 feedrate). An ebullated-bed reactor liquid product stream (22) from this second reactor stage is recycled to the stage two (24) ebullated-bed reactor through the ebullating pump (26) to provide back-mixing which minimizes the temperature difference across the reactor and which also expands the ebullated-bed catalyst to the desired level. Although not shown, a fresh hydrogenation catalyst, for example nickel-molybdenum on alumina, is added to the stage two ebullated-bed reactor (24) and aged catalyst is removed. This catalyst can be the same type of fresh catalyst as used in stage one, spent catalyst cascaded from stage one, regenerated catalyst, or a different hydrotreating or hydrocracking catalyst. Although not shown, a third stage ebullated-bed reactor could be added at similar conditions to the stage two ebullated-bed reactor (24) or at higher or lower temperature conditions. The stage two reactor WABT is at least 25° F. higher than that of the stage one ebullated-bed reactor. After the $2^{nd}$ (or $3^{rd}$) reactor, the effluent is separated and preferably part of the unconverted stream, which typically boils at a minimum of 343° C. (650° F.), is recycled to the feedstock. FIG. 1 shows an advantageous separation.

The product stream (28) from stage two ebullated-bed reactor (24) (or Stage 3 in a three stage configuration) is separated in a high temperature high pressure ("HTHP") separator (30) using conventional vapor/liquid flash separation to form a vapor and a liquid product. The vapor product (32) is cooled through an air cooler (34) and then sent to a high pressure low temperature ("HPLT") separator (38) where separate distillate liquids and vapor streams are recovered. The vapor stream (40) from this HPLT separator (38) is typically thereafter sent to a high pressure amine absorber (44) to remove hydrogen sulfide. The remaining stream (46) is thereafter processed through a high pressure membrane (48) to further recover hydrogen and create a hydrogen stream (50) and a light ends stream (52). The light ends are thereafter passed to a pressure swing absorber ("PSA") to produce fuel gas products (56) ($C_1$-$C_3$ products)and a hydrogen stream (58). The hydrogen stream (58) is thereafter sent to a first make-up compressor (62) where it is combined with a fresh hydrogen stream (60) and recycle hydrogen (50) from the high pressure membrane (48). This combined stream is thereafter sent to a second make-up compressor (64) and used as: i) a stage 1 makeup hydrogen stream (11*a*) and combined with fresh coal pyrolysis feedstock (10) and a makeup hydrogen stream (11*b*) for feed to the second stage ebullated-bed reactor (24).

The heavy oil stream (33) from, the HPHT (30) is combined with the liquid stream (31) from the HPLT separator (38) and reduced in pressure in a medium pressure high temperature ("MPHT") separator (35). A vapor product stream (37) are then cooled through an air cooler (39) and then processed through a medium pressure low temperature separator (41) and subsequently a medium pressure amine absorber (43) before being processed through the pressure swing absorber (54) where it is separated into fuel gas products (56) and $H_2$ (58).

The liquid product stream (45) from the MPHT separator (35) is thereafter combined with the liquid product stream (47) from the medium pressure low temperature separator (41) and liquid products are recovered by processing through a steam stripper (49) or conventional atmospheric distillation (not shown). The light gases are removed overhead to a separator (55) where light liquids and water are recovered and the overhead vapor stream (53) can be vented or used as fuel gas. The recovered liquids (54) are recovered as a separate product or combined with other liquid products from the steam stripper (49) as shown in the figure to produce a synthetic crude oil (SCO). The unconverted heavy atmospheric bottoms oil stream (51) (or a portion thereof) may be recycled to stage 1 for further conversion (51*a*) or included in the finished product as shown.

The heavy atmospheric bottoms stream (51, 51*a*) has a nominal boiling range of 343° C.+ (650° F.+) and can be used to dilute and stabilize the fresh coal liquids feed and to reduce or eliminate fouling of the reactor feed heat exchangers and fired heaters due to the unstable and olefinic feedstock.

The quality of the distillate liquid products are significantly improved compared to the feedstock. Diolefins are completely eliminated. The conversion of the 343° C.+ (650° F.+) material in the feed can be varied from 10 w % to over 99 w %. The sulfur, nitrogen, and oxygen contaminants can be reduced by more than 70% and even up to or more than 90%. The cetane number of the diesel fraction can be increased from less than 30 in the feedstock to the desired levels of 40 to 45. These cetane numbers could be increased by supplemental treatments.

TABLE 1

| Typical Feedstocks | | |
|---|---|---|
| | Coal Pyrolysis - Oil A | Coal Tar - Oil B |
| Gravity, °API | −6.9 | 7.8 |
| Gravity, S.G. | 1.136 | 1.016 |
| Elemental Analysis, W % | | |
| Carbon | 81.6 | 84.1 |
| Hydrogen | 7.2 | 8.5 |
| Nitrogen | 0.7 | 0.8 |
| Sulfur | 2.4 | 0.5 |
| Oxygen | 7.4 | 5.9 |
| Ash | 0.7 | 0.2 |
| Boiling Range, V % | | |
| <204° C. | 0 | 22 |
| 204 to <343° C. | 28.5 | 46 |
| 343 to <440° C. | 24.5 | 17 |
| 440° C.+ | 47.0 | 15 |
| Total | 100.0 | 100 |

EXAMPLE 1

Table 2 below shows the performance of the process using a typical coal pyrolysis oil with two different (single and two-stage) process configurations.

Case 1 is the pre-invention configuration which utilizes a single stage ebullated-bed reactor system.

Case 2 illustrates the performance of the current invention utilizing a two-stage ebullated-bed reactor system with optimized operating conditions.

Utilizing the same amount of reactor volume, the processing configuration of the current invention results in higher conversion, heteroatom removal and improved product quality.

TABLE 2

| Invention Performance | | |
|---|---|---|
| FEEDSTOCK | Coal Pyrolysis - Oil C | |
| Feed Gravity, °API | 4.3 | |
| Feed Gravity, S.G. | 1.042 | |
| Hydrogen, W % | 8.9 | |
| Nitrogen, W % | 0.6 | |
| Sulfur, W % | 0.3 | |
| Oxygen, W % | 7.8 | |
| Boiling Range | | |
| 343° C.− | 43 | |
| 343° C.+ | 57 | |
| | Case | |
| | 1 | 2 |
| Operating Conditions | | |
| Number of Stages | 1 | 2 |
| Type of Reactor | Ebullated-Bed | Ebullated-Bed |
| LHSV, $hr^{-1}$ | 0.4 | 0.4 |
| Reactor Temp., ° C. | 427 | 400/438 |
| H2PP, bar | 124 | 124 |
| Performance | | |
| 440° C.+ Resid Conversion, V % | 77.5 | 83.4 |
| HDS | 93.0 | 98.2 |
| HDN | 62.1 | 74.2 |

TABLE 2-continued

| Invention Performance | | |
|---|---|---|
| $H_2$ Cons., SCF/Bbl | 1850 | 2,560 |
| $C_4$+ Product, V % | 109.4 | 109.7 |
| $C_4$+ °API | 29.8 | 31.2 |
| Sulfur | .02 | .01 |
| Nitrogen | .22 | .16 |
| Hydrogen | 11.76 | 11.93 |

The invention described herein has been disclosed in terms of specific embodiments and applications. However, these details are not meant to be limiting and other embodiments, in light of this teaching, would be obvious to persons skilled in the art. Accordingly, it is to be understood that the drawings and descriptions are illustrative of the principles of the invention, and should not be construed to limit the scope thereof.

We claim:

1. A process of processing coal pyrolysis oils containing at least 15% wt of compounds boiling below 360° C. and less than 40% wt boiling at least at 520° C. said coal pyrolysis oil also containing less than 20% wt of particles of coal having a size of less than 1 mm, and at least 1% wt of oxygenated compounds (calculated as oxygen), said process comprising:

a) combining a hydrogen stream with coal pyrolysis oil feedstock;

b) feeding the combined stream from step a) to a first ebullated-bed reactor to remove compounds including olefins, diolefins, and nitrogen, sulfur, and oxygen contaminates and create a stabilized stream; and c) feeding said stabilized stream to a second ebullated-bed reactor to remove some additional heteroatoms and convert the stream to lower boiling hydrocarbons; and wherein said first ebullated-bed reactor from step b) is always operated at a temperature of at least 15°C. less than said second ebullated-bed reactor of step c) and wherein steps a-c result in the conversion of the 343° C.+ material in said coal pyrolysis oil feedstock in the range of between 10 wt % and 99 wt %.

2. The process of claim one wherein steps a-c result in the conversion of the 343° C.+ material in said coal pyrolysis oil feedstock of greater than 30 wt %.

3. The process of claim one wherein steps a-c result in the conversion of the 343° C.+ material in said coal pyrolysis oil feedstock of greater than 50 wt %.

4. The process of claim one wherein steps a-c result in the conversion of the 343° C.+ material in said coal pyrolysis oil feedstock of greater than 75 wt %.

5. The process of claim one wherein steps a-c result in the conversion of the 343° C.+ material in said coal pyrolysis oil feedstock of greater than 90 wt %.

6. The process of claim one wherein steps a-c result in the conversion of the 343° C.+ material in said coal pyrolysis oil feedstock of greater than 95 wt %.

7. The process of claim one wherein steps a-c result In the reduction of sulfur, nitrogen, and oxygen contaminants In said coal pyrolysis oil feedstock of greater than 70%.

8. The process of claim one wherein steps a-c result in the reduction of sulfur, nitrogen, and oxygen contaminants in said coal pyrolysis oil feedstock of greater than 90%.

9. The process of claim one wherein steps a-c result in the reduction of sulfur, nitrogen, and oxygen contaminants in said coal pyrolysis oil feedstock of greater than 95%.

10. The process of claim one wherein the first ebullaled-bed reactor from step b) is operated at 360° C-420° C., and 69-275 bars hydrogen partial pressure and at a feed rate of 0.5-2.0 volume of feed/hr/settled volume of catalyst in the reactor.

11. The process of claim one wherein the second ebullated-bed reactor from step c) is operated at a temperature of 400-440° C., 69-275 bars hydrogen partial pressure, and a feed rate of 0.2-2.0 volume of feed/hr/settled volume of catalyst in the reactor.

12. The process of claim one wherein a separate heavy oil product stream nominally boiling above 343° C.+ is recycled and blended with the hydrogen stream and coal pyrolysis oil feedstock of step a).

13. The process of claim one wherein the spent catalyst from the ebullated-bed in step b) is cascaded to and used In the ebullated-bed reactor of step c).

14. The process of claim one wherein a separate phenolics stream is combined and processed with the hydrogen stream and coal pyrolysis oil feedstock of step a).

15. The process of claim 14 in which said phenolics stream is combined and processed with the hydrogen stream and coal pyrolysis oil feedstock of step a) at a concentration of 5 wt % to 50 wt % of the coal pyrolysis oil feedstock.

16. The process of claim 15 wherein additional hydrogen is fed to the ebullated-bed reactor of step c).

17. The process of claim 1 wherein crude naphtha is combined and processed with the hydrogen stream and coal pyrolysis oil feedstock of step a) at a concentration of 3 wt % to 30 wt % of the coal pyrolysis oil feedstock.

18. The process of claim one wherein a separate stream, selected from a group consisting of: FCC slurry oil, FCC light cycle oil, decant oil, anthracene oil, coke oven oils, petroleum derived pyrolysis oils, and steam cracker tars, is combined and processed with the hydrogen stream and coal pyrolysis oil in step a).

19. The process of claim 1 wherein a separate heavy wax stream from Fischer-Tropsch processing of synthesis gases, which may contain solids such as catalyst fines, is combined and processed with the hydrogen stream and coal pyrolysis oil feedstock of step a).

20. The process of claim 19 wherein said heavy wax stream from Fischer-Tropsch processing of synthesis gases, which may contain solids such as catalyst fines, is combined and processed with the hydrogen stream and coal pyrolysis oil feedstock of step a) at a concentration of 3 wt % to 30 wt % of the coal pyrolysis oil feedstock.

21. The process of claim 1 wherein the solids content of the coal pyrolysis oils is less than 10 wt. %.

22. The process of claim 1 wherein the solids content of the coal pyrolysis oils is less than 1 wt. %.

23. A process of processing coal pyrolysis oils containing at least 15% wt of compounds boiling below 360° C. and less than 40% wt boiling at least at 520° C. said coal pyrolysis oil also containing less than 20% wt of particles of coal having a size of less than 1 mm, and at least 1% wt of oxygenated compounds (calculated as oxygen), said coal pyrolysis oil being obtained from a process for treating coat, said process comprising:

a. combining a hydrogen stream with a coal pyrolysis oil feedstock;

b. feeding the combined stream from step a) to a first ebullated-bed reactor to remove compounds as olefins, diolefins, and nitrogen, sulfur, and oxygen contaminates and create a stabilized stream; and c. feeding said stabilized stream to a second ebullated-bed reactor to remove some heteroatoms and convert the 343° C+ materials in the stream;

d. feeding said converted stream to one or more additional ebullated-bed reactors for further heteroatom removal and for conversion of the 343° C.+ materials; and wherein said first ebullated-bed reactor from step b) is always operated at a temperature of at least 15° C. less than said second ebullated-bed reactor of step c) and wherein steps a-d result in the conversion of the 343° C.+ material in said coal pyrolysis oil feedstock in the range of between 10 wt % and 99 wt %.

* * * * *